US008646193B1

(12) United States Patent
Li et al.

(10) Patent No.: US 8,646,193 B1
(45) Date of Patent: Feb. 11, 2014

(54) AUTOMATIC PAGE-TURNING DEVICE AND AUTOMATIC PAGE-TURNING SCAN DEVICE USING THE SAME

(75) Inventors: Fong-Jhou Li, New Taipei (TW); Wei-Yuan Peng, New Taipei (TW); Chien-Hui Lee, New Taipei (TW); Chun-Peng Wang, New Taipei (TW); Ta-Jung Kuo, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 13/602,229

(22) Filed: Sep. 3, 2012

(51) Int. Cl.
*G09F 19/00* (2006.01)

(52) U.S. Cl.
USPC ..... 40/533; 84/486

(58) Field of Classification Search
USPC ..... 40/341, 531, 533; 400/709; 84/486, 84/487, 516, 517, 518
See application file for complete search history.

(56) References Cited

U.S. PATENT DOCUMENTS 4,663,873 A * 5/1987 Shinbrot ..... 40/531
4,936,034 A * 6/1990 Chen et al. ..... 40/531
5,794,365 A * 8/1998 Hindermeyer et al. ..... 40/476

* cited by examiner

*Primary Examiner* — Joanne Silbermann

(57) ABSTRACT

An automatic page-turning scan device for automatically turning and scanning pages of a book includes an automatic page-turning device and a scan module. The automatic page-turning device includes a base, a book support, a page-pressing module, a pick-up and page-turning module, and a system controller connected with the book support, the page-pressing module and the pick-up and page-turning module. The book support slidably mounted to the base includes two supporting panels for supporting the book. The page-pressing module is mounted to the supporting panel includes a driving module, and a pressing plate driven by the driving module. The pick-up and page-turning module mounted to the base includes a pick-up holder, a pick-up arm and a path guiding mechanism. The scan module is mounted to the automatic page-turning device, and the system controller controls the scan module to scan the pages of the book.

27 Claims, 8 Drawing Sheets

AUTOMATIC PAGE-TURNING DEVICE AND AUTOMATIC PAGE-TURNING SCAN DEVICE USING THE SAME

BACKGROUND OF THE INVENTION

1. Field of the Invention

The present invention generally relates to a page-turning device and a page-turning scan device using the same, and more particularly to an automatic page-turning device and an automatic page-turning scan device using the same.

2. The Related Art

Referring to FIGS. 1-4, an automatic page-turning device 100' adapted for being used in an automatic page-turning scan device includes a book support 10', a pick-up assembly 20', a page-turning element 30', a device support (not shown) connecting with a front of the book support 10', and a drive unit (not shown) mounted adjacent to one side of the book support 10'. The pick-up assembly 20' includes an axis 22' mounted to a right side of the book support 10', and a friction wheel 21' pivoted to a rear end of the axis 22'. The page-turning element 30' is of an airscrew shape, and mounted to the device support, wherein the page-turning element 30' has three airscrew blades of which one is acted as a page turner 31'. The pick-up assembly 20' and the page-turning element 30' are capable of rotating under a drive of the drive unit.

In use, a book 40' is positioned on the book support 10' of the automatic page-turning device 100'. Once the automatic page-turning device 100' has been initially set up, the friction wheel 21' of the pick-up assembly 20' bears down on an uppermost page of a right side of the book 40' which is disposed on the right side of the book support 10' so as to flatten the uppermost page of the right side of the book 40' before the uppermost page of the right side of the book 40' is turned. When the uppermost page of the right side of the book 40' is ready to be turned, the drive unit drives the friction wheel 21' of the pick-up assembly 20' to rotate clockwise so as to ruckle the uppermost page of the right side of the book 40'. Then the page-turning element 30' rotates anticlockwise to locate the page turner 31' under the uppermost page of the right side of the book 40', and the page-turning element 30' continues rotating anticlockwise to make the page turner 31' turn the uppermost page of the right side of the book 40'. After the uppermost page of the right side of the book 40' has been turned, the page-turning element 30' continues rotating anticlockwise to return to the original position. Repeat the aforesaid operations to complete turning the rest pages of the right side of the book 40'.

However, the axis 22' of the pick-up assembly 20' is fastened to a permanent position of the automatic page-turning device 100', so the friction wheel 21' of the pick-up assembly 20' must overcome different ruckling forces to pick up the pages of the books 40' with different lengths. When the book 40' is with longer pages, the friction wheel 21' need overcome a larger ruckling force of segment A'. When the book 40' is with shorter pages, the friction wheel 21' only need overcome a smaller ruckling force of segment B'. Thus, the friction wheel 21' of the pick-up assembly 20' picking up the pages of the right side of the book 40' at the permanent position of the automatic page-turning device 100' is apt to result in picking up multiple pages of the book 40' in one time or failing to pick up any pages of the book 40'. As a result, a whole operation of the automatic page-turning scan device using the automatic page-turning device 100' is affected.

SUMMARY OF THE INVENTION

An object of the present invention is to provide an automatic page-turning device for automatically turning pages of a book. The automatic page-turning device includes a base, a book support, a page-pressing module, a pick-up and page-turning module and a system controller. The book support is slidably mounted to the base along a left-to-right direction, and includes two supporting panels located above a left side and a right side of the base respectively for supporting the book. The page-pressing module is mounted to a right side of the supporting panel which is located above the right side of the base. The page-pressing module includes a driving module, and a pressing plate driven by the driving module. A distance between the pressing plate and a front edge of the book is permanent. The pick-up and page-turning module is mounted to the base and located in front of the book support. The pick-up and page-turning module includes a pick-up holder having a driving mechanism, a pick-up arm and a path guiding mechanism. A front end of the pick-up arm is pivoted to and slidably mounted to the pick-up holder. The system controller is connected with the book support, the page-pressing module and the pick-up and page-turning module. The system controller controls the driving module to raise up the pressing plate away from an uppermost page of a right side of the book which is supported by the supporting panel located above the right side of the base or lower the pressing plate to press down on the uppermost page of the right side of the book. The system controller controls the driving mechanism to make the pick-up arm move leftward and rightward along the pick-up holder, in this process, a rear end of the pick-up arm is capable of being raised up away from the pages of the book or lowered to press down on the pages of the book under the cooperation guidance of the path guiding mechanism and the pick-up holder. The pressing plate presses down on a right permanent position of the uppermost page of the right side of the book to fasten the uppermost page. The pick-up arm moves leftward and downward to make the rear end thereof rub against and further take along a right corner of a front of the uppermost page of the right side of the book so as to make a front edge of the uppermost page ruckled and spaced from the other pages. The pick-up arm goes on moving and the uppermost page keeps being fastened by the pressing plate so that cause the uppermost page to rebound over the pick-up arm, then the pressing plate is raised up away from the uppermost page of the right side of the book. The pick-up arm further moves leftward under the cooperation guidance of the path guiding mechanism and the pick-up holder to be raised up so as to complete turning the uppermost page leftward.

Another object of the present invention is to provide an automatic page-turning scan device for automatically turning and scanning pages of a book. The automatic page-turning scan device includes an automatic page-turning device and a scan module. The automatic page-turning device includes a base, a book support, a page-pressing module, a pick-up and page-turning module and a system controller. The book support is slidably mounted to the base along a left-to-right direction, and includes two supporting panels located above a left side and a right side of the base respectively for supporting the book. The page-pressing module is mounted to a right side of the supporting panel which is located above the right side of the base. The page-pressing module includes a driving module, and a pressing plate driven by the driving module. A distance between the pressing plate and a front edge of the book is permanent. The pick-up and page-turning module is mounted to the base and located in front of the book support. The pick-up and page-turning module includes a pick-up holder having a driving mechanism, a pick-up arm and a path guiding mechanism. A front end of the pick-up arm is pivoted to and slidably mounted to the pick-up holder. The system controller is connected with the book support, the page-pressing module and the pick-up and page-turning module. The system controller controls the driving module to raise up the pressing plate away from an uppermost page of a right side of the book which is supported by the supporting panel located above the right side of the base or lower the pressing plate to press down on the uppermost page of the right side of the book. The system controller controls the driving mechanism to make the pick-up arm move leftward and rightward along the pick-up holder, in this process, a rear end of the pick-up arm is capable of being raised up away from the pages of the book or lowered to press down on the pages of the book under the cooperation guidance of the path guiding mechanism and the pick-up holder. The pressing plate presses down on a right permanent position of the uppermost page of the right side of the book to fasten the uppermost page. The pick-up arm moves leftward and downward to make the rear end thereof rub against and further take along a right corner of a front of the uppermost page of the right side of the book so as to make a front edge of the uppermost page ruckled and spaced from the other pages, the pick-up arm goes on moving and the uppermost page keeps being fastened by the pressing plate so that cause the uppermost page to rebound over the pick-up arm, then the pressing plate is raised up away from the uppermost page of the right side of the book. The pick-up arm further moves leftward under the cooperation guidance of the path guiding mechanism and the pick-up holder to be raised up so as to complete turning the uppermost page leftward.

As described above, when the automatic page-turning device is in operation, the system controller controls the pressing plate to press down on the right permanent position of the uppermost page of the right side of the book, so the distance between the pressing plate and front edges of the supporting panels is permanent, namely, the distance between the pressing plate and the front edge of each page of the right side of the book is permanent, the pressing plate provides ruckling force for picking up the uppermost page of the right side of the book in the process of fastening the uppermost page. The pick-up arm takes along the uppermost page of the right side of the book to complete picking up the uppermost page of the right side of the book. In the process of picking up the uppermost page of the right side of one of the books with different lengths, the pick-up arm only need overcome the ruckling force of segment A ranged between the pressing plate and the front edge of the uppermost page of the right side of the book to complete picking up the uppermost page of the right side of the one of the books with different lengths. Consequently, in the process of picking up the uppermost page of the right side of the book, the pick-up arm only need overcome the permanent ruckling force for improving the conditions of picking up the multiple pages of the right side of the book and failing to pick up the pages of the right side of the book. After the pick-up arm picking up the uppermost page of the right side of the book, then the pressing plate is raised up away from the uppermost page of the right side of the book, the pick-up arm further moves leftward under the cooperation guidance of the path guiding mechanism and the pick-up holder to be raised up so as to complete turning the uppermost page of the right side of the book so as to make the automatic page-turning scan device scan the pages of the book successfully.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
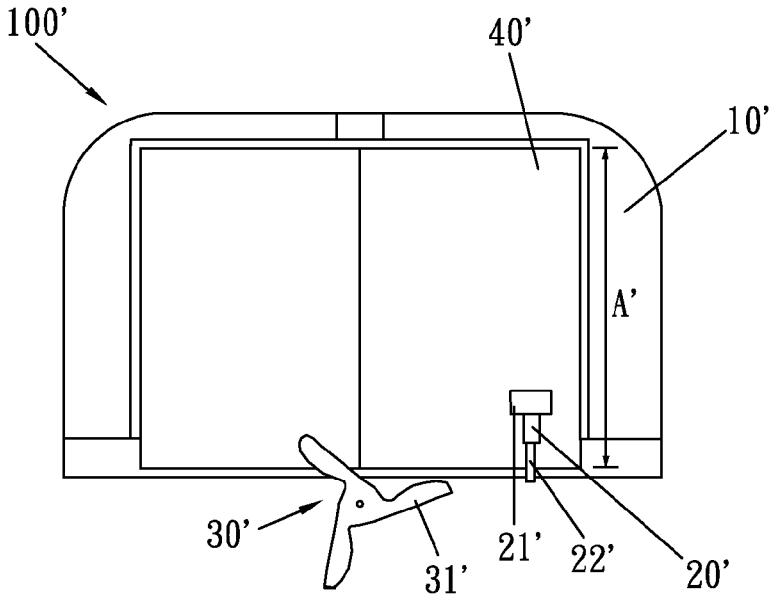
FIG. 1 (Prior Art)
FIG. 1 is a schematic plan view of an automatic page-turning device in prior art, wherein a book with longer pages is positioned on the automatic page-turning device.
Figure 2:
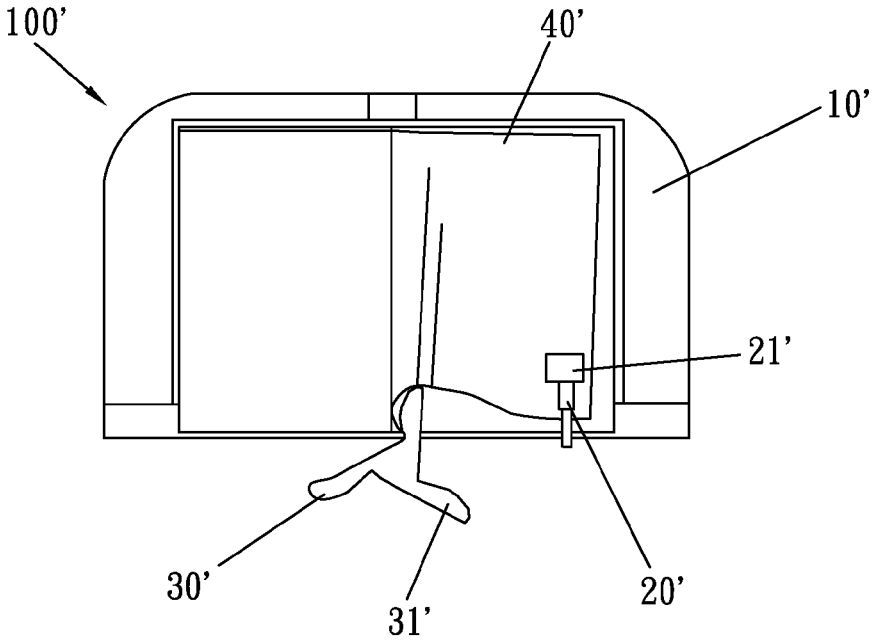
FIG. 2 (Prior Art)
FIG. 2 is a schematic plan view of the automatic page-turning device of FIG. 1, wherein an uppermost page of a right side of the book is being turned.
Figure 3:
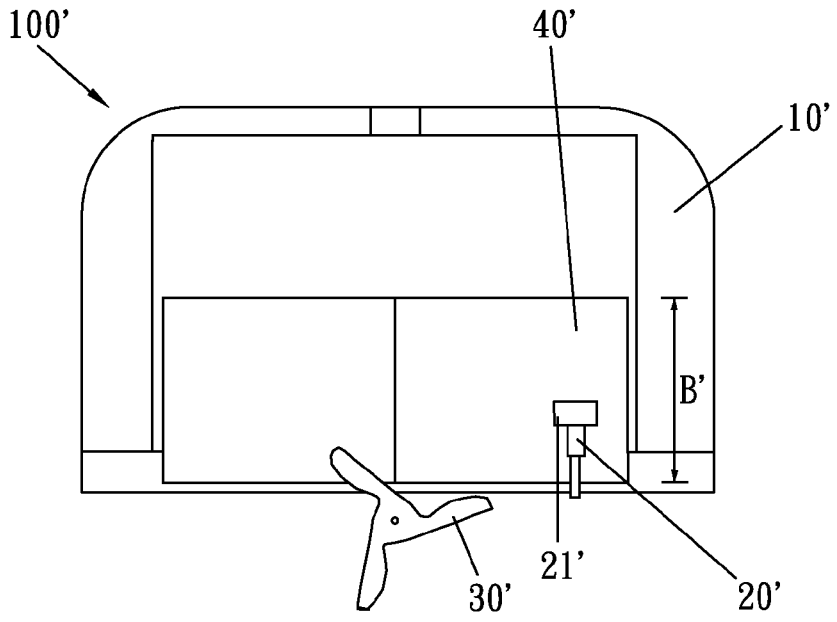
FIG. 3 (Prior Art)
FIG. 3 is a schematic plan view of the automatic page-turning device of FIG. 1, wherein a book with shorter pages is positioned on the automatic page-turning device.
Figure 4:
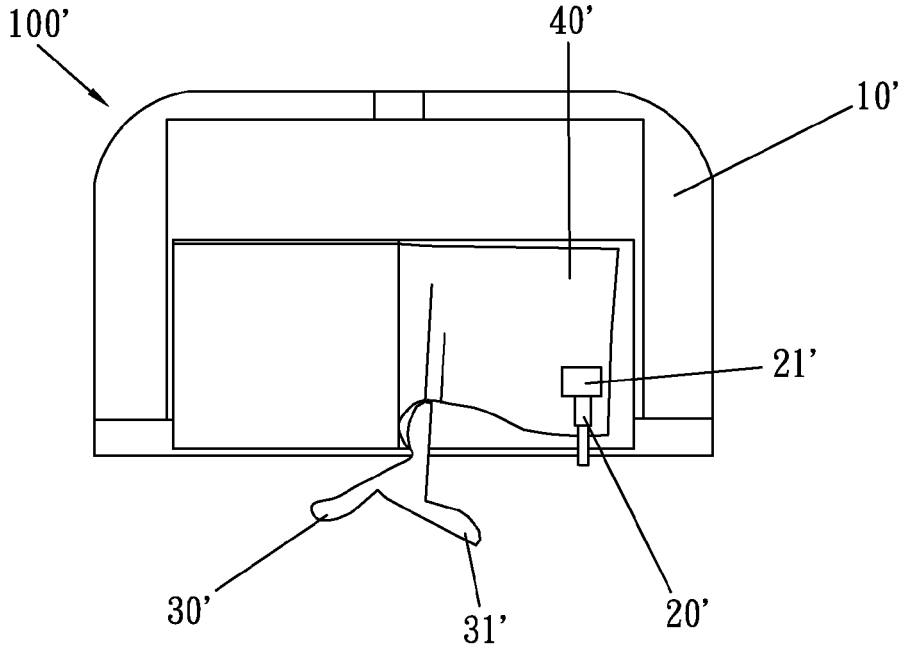
FIG. 4 (Prior Art)
FIG. 4 is a schematic plan view of the automatic page-turning device of FIG. 3, wherein an uppermost page of the right side of the book is being turned.
Figure 5:
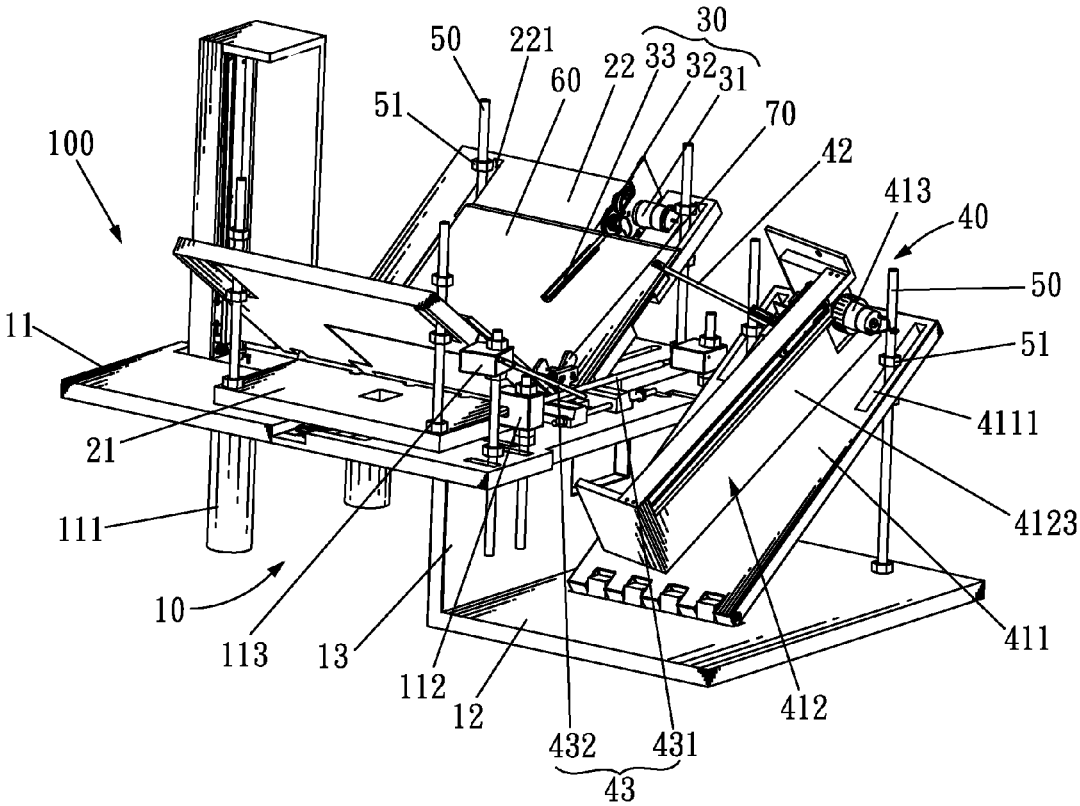
FIG. 5 is a perspective view of an automatic page-turning device in accordance with the present invention, wherein a book is positioned on the automatic page-turning device.
Figure 6:
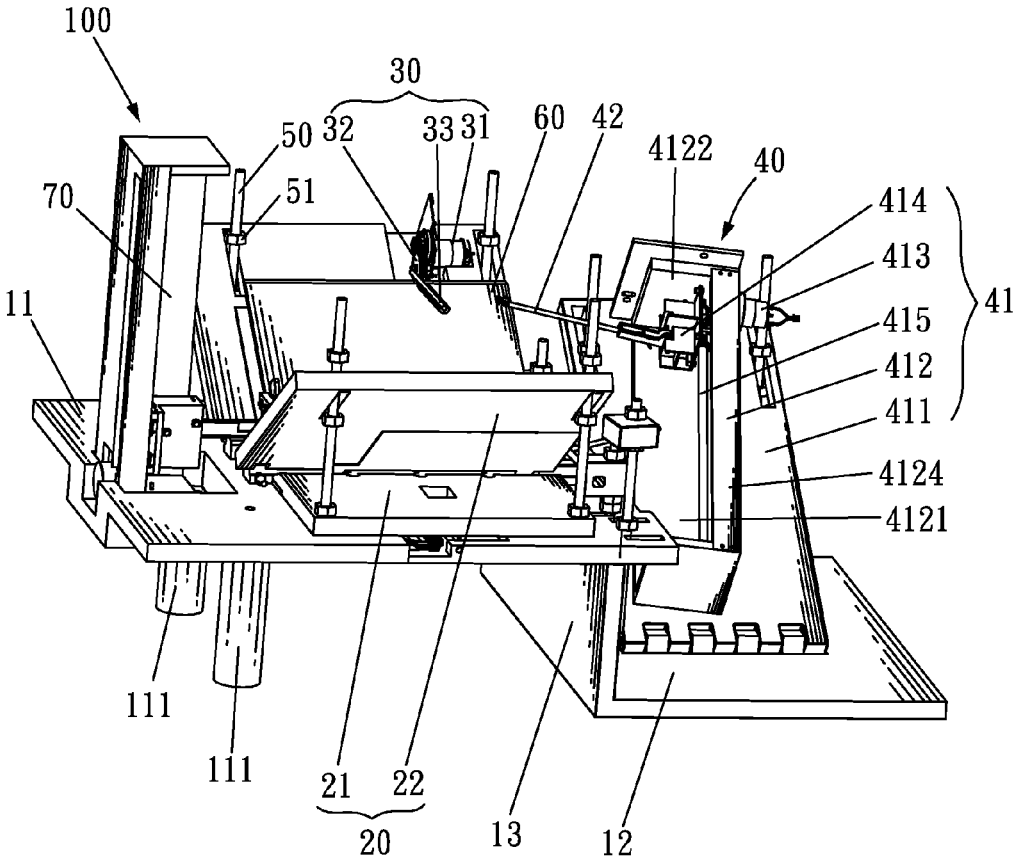
FIG. 6 is another perspective view of the automatic page-turning device of FIG. 5, wherein the book is positioned on the automatic page-turning device.
Figure 7:
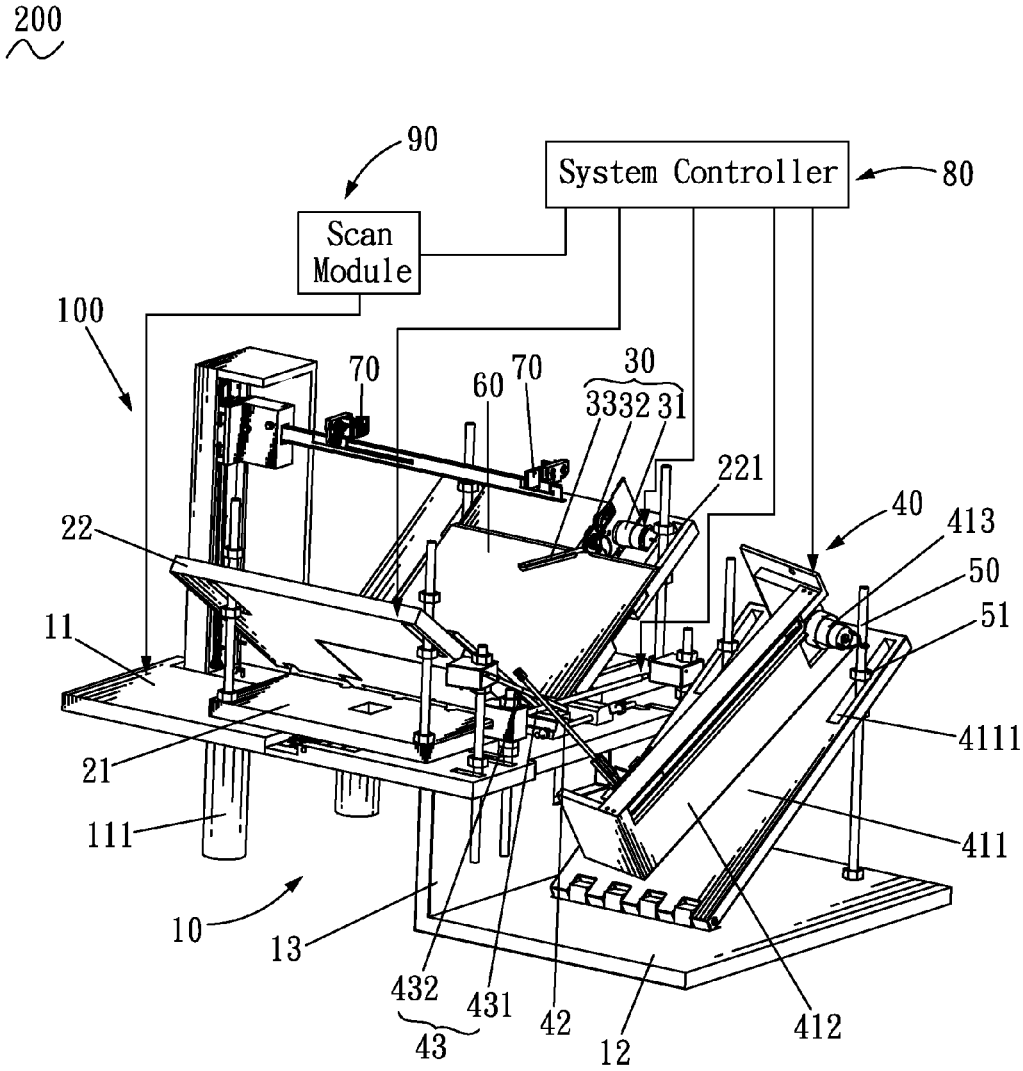
FIG. 7 is a perspective view of an automatic page-turning scan device including the automatic page-turning device of FIG. 5, wherein an uppermost page of a right side of the book is turned.
Figure 8:
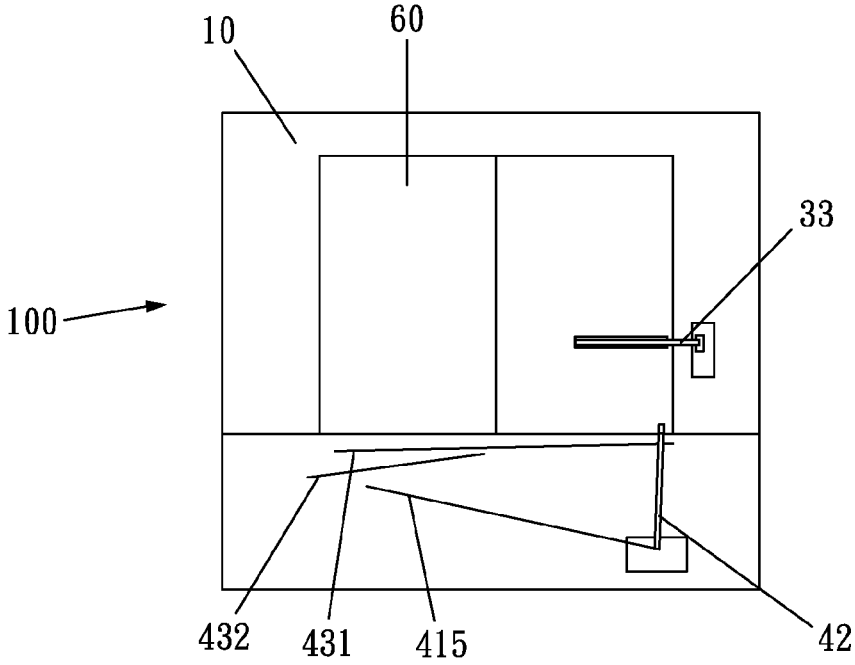
FIGS. 8 to 12 are schematic plan views of the automatic page-turning device of FIG. 5, showing different turning statues of the book with longer pages.
Figure 9:
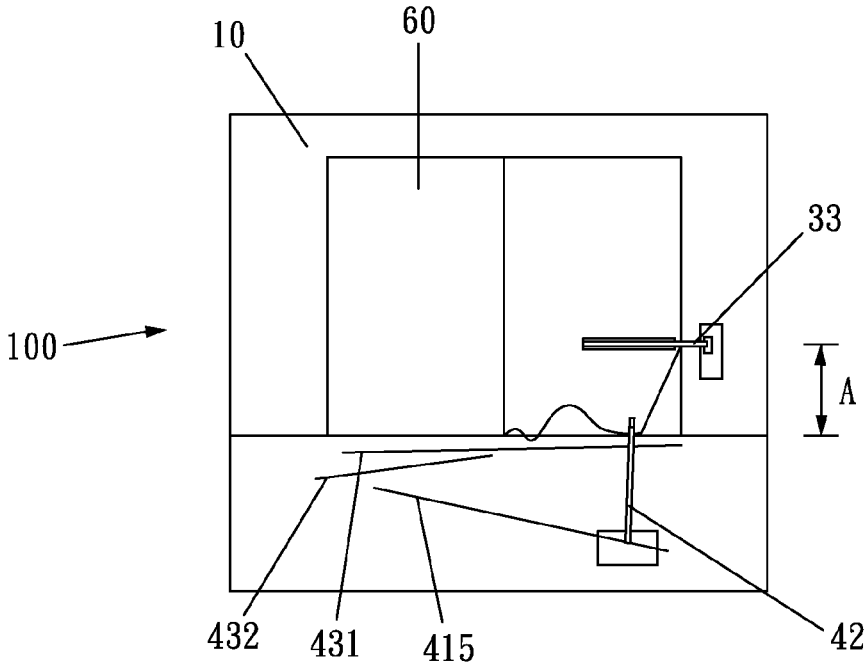
Figure 10:
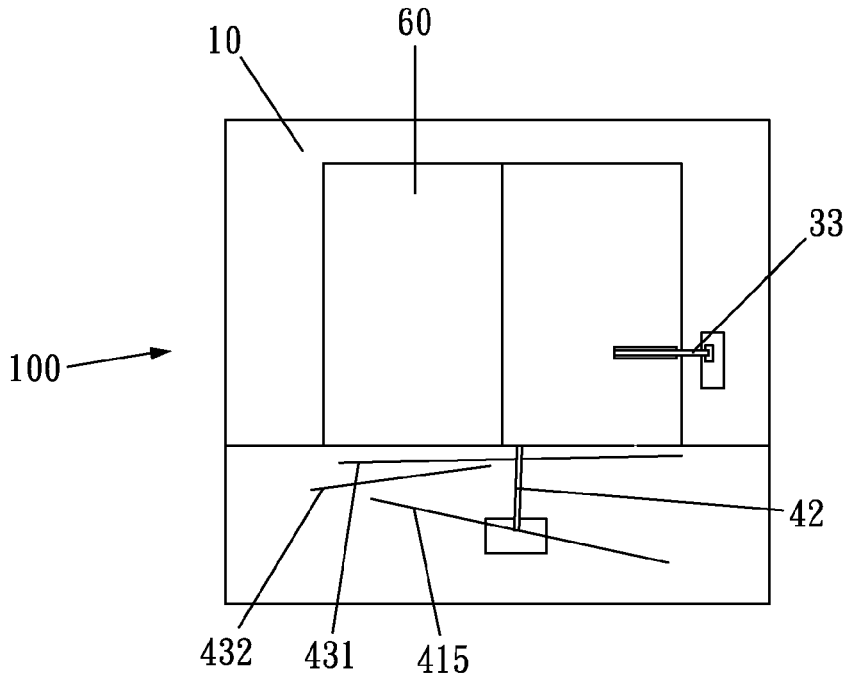
Figure 11:
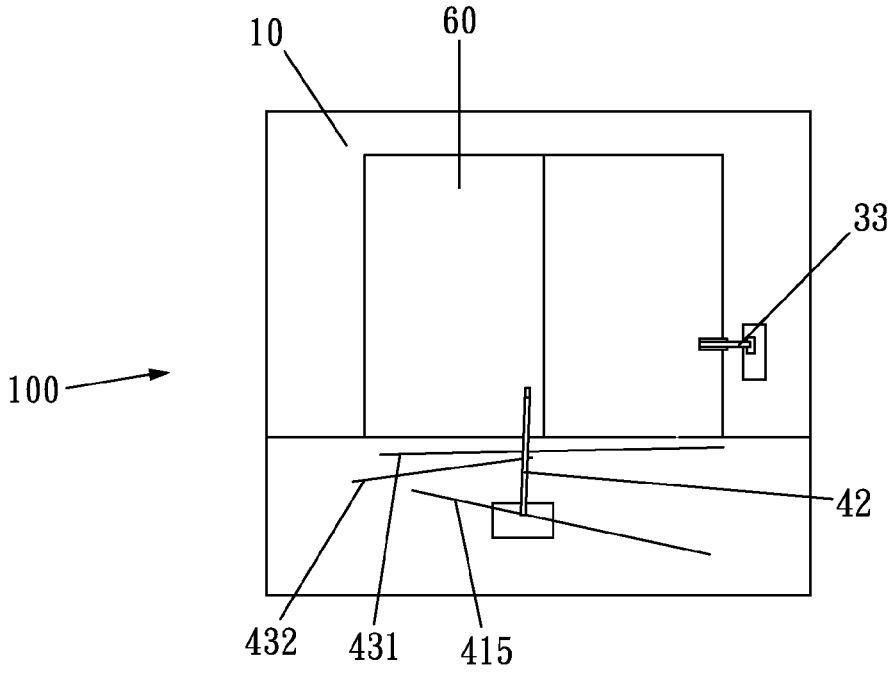
Figure 12:
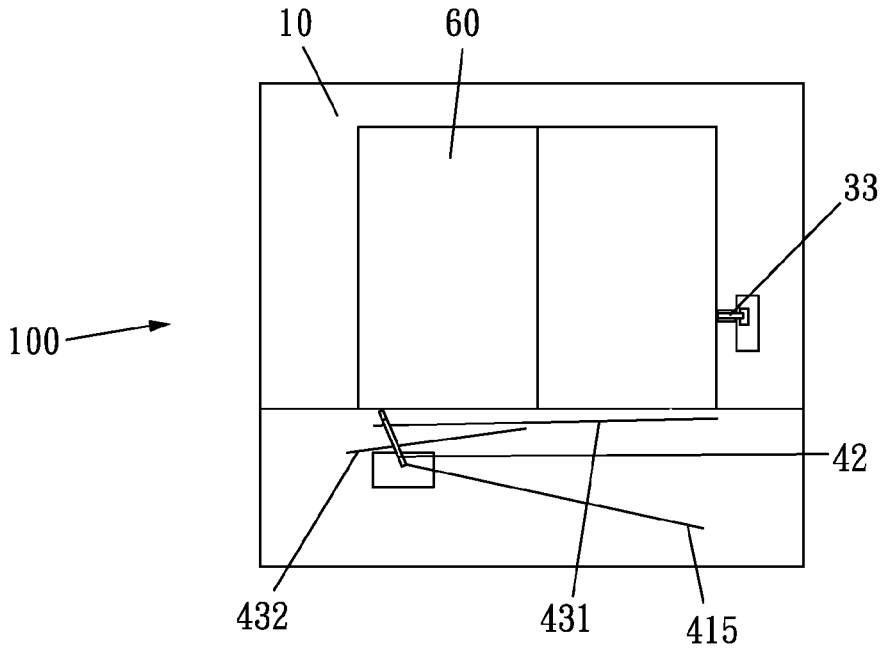
Figure 13:
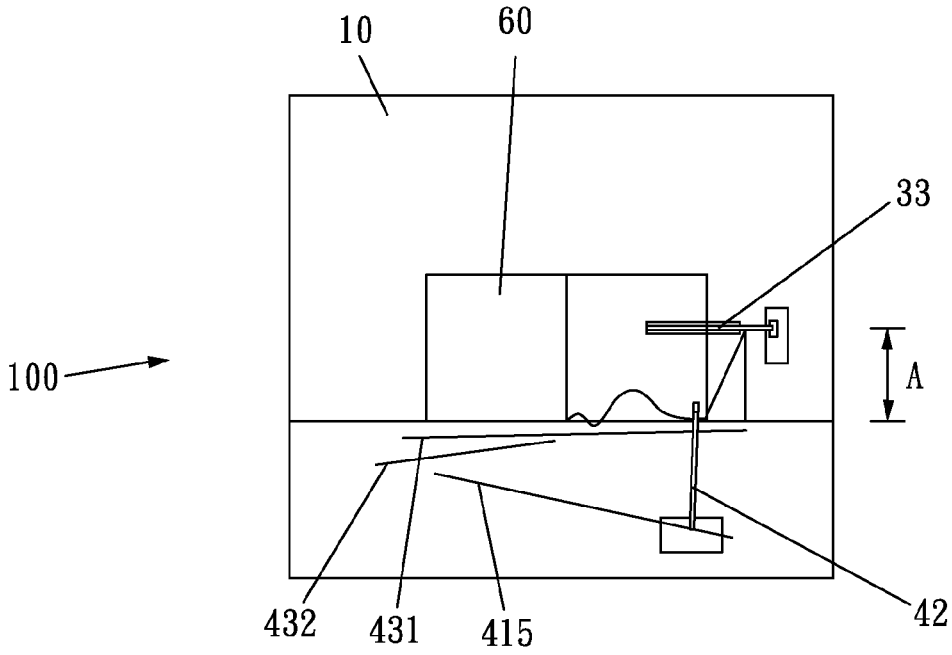
FIG. 13 is a schematic plan view of the automatic page-turning device of FIG. 5, wherein the book with shorter pages is being turned.

With reference to FIG. 5, FIG. 6 and FIG. 7, an automatic page-turning scan device 200 in accordance with the present invention is used for automatically turning and scanning pages of a book 60. As shown in FIG. 7, the automatic page-turning scan device 200 includes an automatic page-turning device 100, and a scan module 90 mounted to the automatic page-turning device 100.

The automatic page-turning device 100 is used for automatically turning the pages of the book 60. The book 60 includes a plurality of the pages which are bound or unbound, and a central spine (not shown) supporting the pages. The automatic page-turning device 100 includes a base 10, a book support 20, a page-pressing module 30, a pick-up and page-turning module 40, and a system controller 80 connected with the book support 20, the page-pressing module 30 and the pick-up and page-turning module 40. The system controller 80 can be a computer or other electronic equipment.

Referring to FIGS. 5-7, the base 10 includes an upper plate 11, a lower plate 12 and a connecting plate 13. The upper plate 11 and the lower plate 12 are disposed horizontally. The connecting plate 13 is connected between a front of the upper plate 11 and a rear of the lower plate 12. A bottom surface of the upper plate 11 protrudes downward to form a plurality of propping columns 111 for propping up the upper plate 11.

The book support 20 is slidably mounted to the base 10 along a left-to-right direction. The book support 20 includes two loading panels 21 and two supporting panels 22 for supporting the book 60. The two loading panels 21 are slidably mounted to a left side and a right side of the upper plate 11 of the base 10 and capable of sliding leftward and rightward along the upper plate 11. The two loading panels 21 are permanently connected with each other and spaced from each other. Two inner sides of the two supporting panels 22 are connected with two inner sides of the two loading panels 21, and two outer sides of the two supporting panels 22 are propped up by the two loading panels 21 and are inclined upward and oppositely so as to make the two supporting panels 22 fastened to the two loading panels 21 and show a V shape seen from a front view. Accordingly, the two supporting panels 22 are located above the left side and the right side of the upper plate 11 of the base 10 respectively for supporting the pages of a left side and a right side of the book 60. In use, inclinations of the two supporting panels 22 with respect to the two loading panels 21 can be modulated according to actual needs. Specifically, a front and a rear of the outer side of each supporting panel 22 open a fastening hole 221 extending along the inclined direction of the supporting panel 22. The automatic page-turning device 100 further includes a plurality of supporting pillars 50 and fastening elements 51. One supporting pillar 50 passes through one of the fastening holes 221 to be fastened to the corresponding loading panel 21. Three fastening elements 51 are fastened to each supporting pillar 50. One fastening element 51 is fastened to a bottom of the supporting pillar 50 where is fastened to the loading panel 21, and the other two fastening elements 51 are respectively fastened above the fastening hole 221 and below the fastening hole 221 for fastening the outer side of the supporting panel 22 between the two fastening elements 51. The system controller modulates horizontal positions of the loading panels 21 to drive the supporting panels 22 to slide leftward and rightward. The inclination of the supporting panel 22 with respect to the corresponding loading panel 21 can be modulated by means of modulating a vertical position of the fastening hole 221 located in the corresponding supporting pillar 50.

Referring to FIG. 5 and FIG. 6, the page-pressing module 30 is mounted to a right side of the supporting panel 22 which is located above the right side of the upper plate 11 of the base 10. The page-pressing module 30 includes a driving module (not labeled), and a pressing plate 33 driven by the driving module. The driving module further includes a motor 31, and a gear assembly 32 mounted to an axle of the motor 31. One end of the pressing plate 33 is mounted to the gear assembly 32 and the other end of the pressing plate 33 is set freely. The system controller controls the motor 31 of the driving module to rotate to drive the gear assembly 32 of the driving module to raise up the pressing plate 33 away from an uppermost page of the right side of the book 60 or lower the pressing plate 33 to press down on the uppermost page of the right side of the book 60.

Referring to FIG. 5, FIG. 6 and FIG. 7, the pick-up and page-turning module 40 is mounted to the base 10 and located in front of the book support 20. The pick-up and page-turning module 40 includes a pick-up holder 41, a pick-up arm 42 and a path guiding mechanism 43. The pick-up holder 41 is mounted on the lower plate 12 of the base 10. A front end of the pick-up arm 42 is pivoted to and slidably mounted to the pick-up holder 41. The system controller controls the driving mechanism 413 to make the pick-up arm 42 move leftward and rightward along the pick-up holder 41, in this process, a rear end of the pick-up arm 42 is capable of being raised up away from the pages of the book 60 or lowered to press down on the pages of the book 60 under the cooperation guidance of the path guiding mechanism 43 and the pick-up holder 41. The system controller is capable of further making the driving mechanism 413 drive the pick-up arm 42 to swing upward and downward by pivoting the pick-up holder 41 for the convenience of putting and taking the book 60. Specifically, the pick-up holder 41 includes a fastening board 411, an assembling holder 412 mounted to the fastening board 411, a driving mechanism 413 disposed to the assembling holder 412, a connecting stick 415 mounted to the assembling holder 412, and a flexible seat 414 movably mounted to the connecting stick 415 of the assembling holder 412. The fastening board 411 is slantwise mounted to the lower plate 12 along an upward and rightward direction with a left side thereof being pivoted to the lower plate 12 and a right side thereof being set freely. The right side of the fastening board 411 defines a fixing hole 4111. One supporting pillar 50 passes through the fixing hole 4111 to be fastened to the lower plate 12. One fastening element 51 is fastened to a bottom of the supporting pillar 50 where is fastened to the lower plate 12, and the other two fastening elements 51 are respectively fastened above the fixing hole 4111 and below the fixing hole 4111 for fastening the right side of the fastening board 411 between the two fastening elements 51.

The assembling holder 412 is slantwise mounted to the fastening board 411 and is gradually inclined forward from a left side thereof to a right side thereof. The assembling holder 412 has a bottom board 4121, two side boards 4122 extending upward from two opposite sides of the bottom board 4121, a front board 4123 connecting with the two side boards 4122 and the bottom board 4121, and a top board 4124 connecting with the two side boards 4122 and the front board 4123. The connecting stick 415 is slantwise connected between the two side boards 4122. The connecting stick 415 is inclined forward from a left side thereof to a right side thereof, and has a same inclination as that of the assembling holder 412. The flexible seat 414 is slidably disposed to the connecting stick 415. The assembling holder 412 slantwise mounted to the fastening board 411 and the connecting stick 415 slantwise connected between the two side boards 4122 have the same inclination so as to facilitate the pick-up arm 42 for pressing down on a front of the uppermost page of the right side of the book 60 when the pick-up arm 42 is located at the uppermost page of the right side of the book 60, and facilitate the pick-up arm 42 for moving leftward and rearward to project between the pages of a left side and the right side of the book 60 to further press down on a reverse of the turned uppermost page of the right side of the book 60 to the left side of the book 60 after the uppermost page of the right side of the book 60 is turned.

The system controller controls the driving mechanism 413 to drive the flexible seat 414 to slide along the connecting stick 415. A front of the pick-up arm 42 is pivoted to the connecting stick 415 of the flexible seat 414. So that the system controller is capable of further making the driving mechanism 413 drive the pick-up arm 42 to swing upward and downward by pivoting the connecting stick 415 of the pick-up holder 41. The system controller controls the pick-up arm 42 to keep pressing down on the pages of the book 60 during a process of turning the uppermost page of the right side of the book 60. The pick-up arm 42 is made of high friction coefficient material, such as rubber.

The path guiding mechanism 43 includes a guiding rod 431 and a lifting rod 432. Two first auxiliary fastening portions 112 are mounted to a left side and a right side of a front of the upper plate 11 of the base 10 to be located in front of the book support 20. A second auxiliary fastening portion 113 is mounted to the left side of the front of the upper plate 11 of the base 10, and further located in left of the first auxiliary fastening portion 112 which is mounted to the left side of the front of the upper plate 11. The second auxiliary fastening portion 113 is higher than the first auxiliary fastening portions 112. Two opposite ends of the guiding rod 431 are mounted to the two first auxiliary fastening portions 112 to make the guiding rod 431 located in front of a middle of the book support 20 and parallel to the upper plate 11 of the base 10. A left end of the lifting rod 432 is mounted to a top of the second auxiliary fastening portion 113, and a right end of the lifting rod 432 is connected with a middle of the guiding rod 431 to make the lifting rod 432 slantwise disposed in front of a left side of the book support 20. The right end of the lifting rod 432 further projects under the guiding rod 431 to be located in front of a junction of the two supporting panels 22 so as to make the guiding rod 431 and the lifting rod 432 cross set. The guiding rod 431 can integrate with the lifting rod 432 to be disposed to the upper plate 11 of the base 10. The guiding rod 431 and the lifting rod 432 can be respectively disposed to the upper plate 11 of the base 10. The rear end of the pick-up arm 42 is movably disposed above the guiding rod 431 and the lifting rod 432 of the path guiding mechanism 43. The rear end of the pick-up arm 42 can swing downward to press down on the supporting panel 22 or swing upward away from the supporting panel 22 under the guidance of the connecting stick 415, the guiding rod 431 and the lifting rod 432.

The scan module is mounted above the book support 20 of the automatic page-turning device 100, and is controlled by the system controller to scan the pages of the book 60.

Referring to FIG. 5, FIG. 6, FIG. 8, FIG. 9, FIG. 10, FIG. 11, FIG. 12 and FIG. 13, when the automatic page-turning device 100 is in operation, working process of the automatic page-turning device 100 in accordance with the present invention is described as follows.

When the automatic page-turning device 100 is used for turning the pages of the book 60, firstly, the pressing plate 33 is raised up, the book 60 is put on the supporting panels 22 of the book support 20. The central spine of book 60 is positioned between the two supporting panels 22 of the book support 20. The pages of the right side of the book 60 need be turned are put on the supporting panel 22 which is located above the right side of the upper plate 11, and the pages of the left side of the book 60 are put on the supporting panel 22 which is located above the left side of the upper plate 11. The system controller controls the motor 31 to rotate to drive the gear assembly 32 to rotate clockwise or anticlockwise so as to raise up the pressing plate 33 away from the uppermost page of the right side of the book 60 or lower the pressing plate 33 to press down on the uppermost page of the right side of the book 60 so as to fasten the uppermost page. The system controller controls horizontal positions of the loading panels 21 to drive the supporting panels 22 to move leftward and rightward so as to make the supporting panels 22 move to a precalculated position. Simultaneously, the system controller controls the driving mechanism 413 to make the pick-up arm 42 move to and press down on a right corner of a front of the uppermost page of the right side of the book 60 under the guidance of the guiding rod 431 and the lifting rod 432. An inclination of the pick-up and page-turning module 40 is modulated to be the same as that of the supporting panel 22 which is located above the right side of the upper plate 11 so that the inclination of the pick-up and page-turning module 40 is substantially the same as that of the pages of the right side of the book 60. Because the two loading panels 21 are disposed spaced from each other, an interval between the two loading panels 21 can be modulated to clamp the central spine of the book 60 tightly according to a thickness of the book 60 so that the book support 20 can compensate central positions of the books 60 with different thicknesses for assuring a correct pick-up position of the pick-up and page-turning module 40 and a correct pressing position of the page-pressing module 30.

Secondly, when the pick-up arm 42 arrives at a position set by the system controller, the system controller continues controlling the motor 31 of the driving module to rotate to drive the gear assembly 32 of the driving module to rotate anticlockwise so as to drive the pressing plate 33 to press down on a right permanent position of the uppermost page of the right side of the book 60 so as to fasten the uppermost page. Simultaneously, the system controller controls the driving mechanism 413 again to make the pick-up arm 42 move leftward and downward along the connecting stick 415. Because the pressing plate 33 presses down on the right permanent position of the uppermost page of the right side of the book 60, the rear end of the pick-up arm 42 rubs against and further takes along the right corner of the front of the uppermost page of the right side of the book 60 so as to make a front edge of the uppermost page of the right side of the book 60 located in left of the pick-up arm 42 ruckled and spaced from the other pages of the book 60 to form a gap (not labeled) therebetween. When the pick-up arm 42 moves leftward and downward to an extent along the connecting stick 415, because the pick-up arm 42 goes on moving and the right permanent position of the uppermost page of the right side of the book 60 keeps being fastened by the pressing plate 33 so that cause the uppermost page to rebound over the pick-up arm 42 for making the pick-up arm 42 project into the gap to be under the taken uppermost page of the right side of the book 60, then the pressing plate 33 is raised up away from the uppermost page of the right side of the book 60. The pick-up arm 42 further moves leftward under the cooperation guidance of the path guiding mechanism 43 and the pick-up holder 41 to be raised up so as to complete turning the uppermost page leftward. The system controller controls the pressing plate 33 pressing down on the uppermost page of the right side of the book 60 to raise up slowly away from the uppermost page of the right side of the book 60, and controls the flexible seat 414 to slide leftward and downward along the connecting stick 415 so as to drive the pick-up arm 42 to show a pressing down status all the time. But the pick-up arm 42 is supported by the guiding rod 431 of the path guiding mechanism 43 so that the rear end of the pick-up arm 42 no longer presses down on the uppermost page of the right side of the book 60 for effectively preventing the pick-up arm 42 from keeping touching the pages of the book 60 to pick up multiple pages at one time, and then the system controller controls the pick-up arm 42 to go on moving leftward under the cooperation guidance of the path guiding mechanism 43 and the pick-up holder 41 to be raised up away from the pages of the book 60 so as to complete turning the uppermost page leftward. The system controller controls the scan module to begin scanning a new uppermost page of the right side of the book 60. Specifically, in the process, when the pick-up arm 42 further moves downward and leftward to a junction between the guiding rod 431 and the lifting rod 432 along the connecting stick 415, due to the function of the lifting rod 432, the pick-up arm 42 is raised up in the process of the pick-up arm 42 continuing moving leftward so as to take along the uppermost page of the right side of the book 60 and then move leftward to press down on the uppermost page of the right side of the book 60 to complete turning the uppermost page of the right side of the book 60. In addition, the connecting stick 415 is slantwise disposed to the pick-up holder 41, and the pick-up arm 42 further projects between the uppermost page of the right side of the book 60 and the other pages of the book 60 in the process of the pick-up arm 42 moving leftward and downward along the connecting stick 415, it's beneficial for the pick-up arm 42 to turn the uppermost page of the right side of the book 60. Repeat the above-mentioned motions, it can complete turning the pages of the right side of the whole book 60. Moreover, due to the function of the lifting rod 432, when the pick-up arm 42 slides to the pages of the left side of the book 60, the pick-up arm 42 is raised up away from the pages of the book 60. Simultaneously, the system controller continues controlling the motor 31 of the driving module to rotate to drive the gear assembly 32 of the driving module to rotate clockwise to drive the pressing plate 33 to raise up away from the new uppermost page of the right side of the book 60, it's beneficial for the scan module to proceed the scanning operation.

Then, the system controller controls the motor 31 to rotate again to drive the gear assembly 32 to rotate anticlockwise so as to drive the pressing plate 33 to press down on the new uppermost page of the right side of the book 60. The system controller also controls the driving mechanism 413 to drive the pick-up arm 42 to move to a right corner of a front of the new uppermost page of the right side of the book 60 under the guidance of the guiding rod 431 and the lifting rod 432, and then press down on the right corner of the front of the new uppermost page of the right side of the book 60 to proceed turning the new uppermost page of the right side of the book 60. So repeatedly, complete turning the pages of the right side of the whole book 60.

Preferably, the automatic page-turning device 100 of the automatic page-turning scan device further includes an auxiliary pressing module 70 mounted to the upper plate 11 of the base 10. The auxiliary pressing module 70 is capable of being raised away from the supporting panels 22 or being lowered to press down on a front and a rear of a middle of the book 60 under the control of the system controller. Specifically, the auxiliary pressing module 70 presses down on the front and the rear of the middle of the book 60 to flatten the pages of the book 60 before the automatic page-turning device 100 picking up the uppermost page of the right side of the book 60, and the page-pressing module 30 presses down on the right permanent position of the uppermost page of the right side of the book 60 for assuring the pick-up and page-turning module 40 to pick up the uppermost page of the right side of the book 60 successfully. After picking up the uppermost page of the right side of the book 60, the auxiliary pressing module 70 moves upward away from the supporting panels 22 so as to let the pick-up arm 42 turn the uppermost page of the right side of the book 60 successfully. After the automatic page-turning device 100 turning the uppermost page of the right side of the book 60, the auxiliary pressing module 70 is lowered again to press down on the front and the rear of the middle of the book 60 to flatten the pages of the book 60, then the auxiliary pressing module 70 is raised up for making the pick-up arm 42 successfully return to the right side of the book 60, repeat the reciprocating operations like the above-mentioned description.

Referring to FIGS. 8-13, based on the above-mentioned description, it can be known that the automatic page-turning device 100 uses the pressing plate 33 to fasten the uppermost page of the right side of the book 60, and when the uppermost page is fastened by the pressing plate 33, a normal force is provided to press down on the pages of the book 60. In the process of the automatic page-turning device 100 turning the uppermost page of the right side of one of the books 60 with different lengths, when the pick-up arm 42 picks up the uppermost page of the right side of the one of the books 60 with different lengths, the pick-up arm 42 only need overcome a ruckling force of segment A ranged between the pressing plate 33 and a front edge of the book 60 to complete picking up the uppermost page of the right side of the book 60. Because the distance between the pressing plate 33 and front edges of the supporting panels 22 is permanent, namely, the distance between the pressing plate 33 and the front edge of each page of the right side of the book 60 is permanent, so the distance of segment A is a permanent value, the ruckling force of segment A won't be changed according to the different lengths of the books 60. Consequently, in the process of picking up the uppermost page of the right side of the book 60, the pick-up arm 42 only need overcome the permanent ruckling force for improving conditions of picking up the multiple pages of the right side of the book 60 and failing to pick up the pages of the right side of the book 60. After the pick-up arm 42 picking up the uppermost page of the right side of the book 60, the pressing plate 33 is raised up away from the uppermost page of the right side of the book 60, the pick-up arm 42 further moves leftward under the cooperation guidance of the path guiding mechanism 43 and the pick-up holder 41 to be raised up so as to complete turning the uppermost page leftward so as to make the automatic page-turning scan device scan the pages of the book 60 successfully.

As described above, when the automatic page-turning device 100 is in operation, the system controller controls the pressing plate 33 to press down on the right permanent position of the uppermost page of the right side of the book 60, so the distance between the pressing plate 33 and the front edges of the supporting panels 22 is permanent, namely, the distance between the pressing plate 33 and the front edge of each page of the right side of the book 60 is permanent, the pressing plate 33 provides the ruckling force for picking up the uppermost page of the right side of the book 60 in the process of fastening the uppermost page. The pick-up arm 42 takes along the uppermost page of the right side of the book 60 to complete picking up the uppermost page of the right side of the book 60. In the process of picking up the uppermost page of the right side of one of the books 60 with different lengths, the pick-up arm 42 only need overcome the ruckling force of segment A ranged between the pressing plate 33 and the front edge of the uppermost page of the right side of the book 60 to complete picking up the uppermost page of the right side of the one of the books 60 with different lengths. Consequently, in the process of picking up the uppermost page of the right side of the book 60, the pick-up arm 42 only need overcome the permanent ruckling force for improving the conditions of picking up the multiple pages of the right side of the book 60 and failing to pick up the pages of the right side of the book 60. After the pick-up arm 42 picking up the uppermost page of the right side of the book 60, then the pressing plate 33 is raised up away from the uppermost page of the right side of the book 60, the pick-up arm 42 further moves leftward under the cooperation guidance of the path guiding mechanism 43 and the pick-up holder 41 to be raised up so as to complete turning the uppermost page of the right side of the book 60 so as to make the automatic page-turning scan device scan the pages of the book 60 successfully.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An automatic page-turning device for automatically turning pages of a book, comprising:

a base;

a book support slidably mounted to the base along a left-to-right direction, and including two supporting panels located above a left side and a right side of the base respectively for supporting the book;

a page-pressing module mounted to a right side of the supporting panel which is located above the right side of the base, the page-pressing module including a driving module, and a pressing plate driven by the driving module, a distance between the pressing plate and a front edge of each page of the book being permanent;

a pick-up and page-turning module mounted to the base and located in front of the book support, the pick-up and page-turning module including a pick-up holder having a driving mechanism, a pick-up arm and a path guiding mechanism, a front end of the pick-up arm being pivoted to and slidably mounted to the pick-up holder; and a system controller connected with the book support, the page-pressing module and the pick-up and page-turning module, the system controller controlling the driving module to raise up the pressing plate away from an uppermost page of a right side of the book which is supported by the supporting panel located above the right side of the base or lower the pressing plate to press down on the uppermost page of the right side of the book, the system controller controlling the driving mechanism to make the pick-up arm move leftward and rightward along the pick-up holder, in this process, a rear end of the pick-up arm being capable of being raised up away from the pages of the book or lowered to press down on the pages of the book under the cooperation guidance of the path guiding mechanism and the pick-up holder, wherein the pressing plate presses down on a right permanent position of the uppermost page of the right side of the book to fasten the uppermost page, the pick-up arm moves leftward and downward to make the rear end thereof rub against and further take along a right corner of a front of the uppermost page of the right side of the book so as to make a front edge of the uppermost page ruckled and spaced from the other pages, the pick-up arm goes on moving and the uppermost page keeps being fastened by the pressing plate so that cause the uppermost page to rebound over the pick-up arm, then the pressing plate is raised up away from the uppermost page of the right side of the book, the pick-up arm further moves leftward under the cooperation guidance of the path guiding mechanism and the pick-up holder to be raised up so as to complete turning the uppermost page leftward.

2. The automatic page-turning device as claimed in claim 1, wherein the base includes an upper plate, a lower plate and a connecting plate, the upper plate and the lower plate are disposed horizontally, the connecting plate is connected between a front of the upper plate and a rear of the lower plate, the two loading panels are slidably mounted to a left side and a right side of the upper plate of the base and capable of sliding leftward and rightward along the upper plate, the two loading panels are permanently connected with each other and spaced from each other, two inner sides of the two supporting panels are connected with two inner sides of the two loading panels, and two outer sides of the two supporting panels are propped up by the two loading panels and are inclined upward and oppositely, the system controller controls horizontal positions of the loading panels to drive the supporting panels to move leftward and rightward.

3. The automatic page-turning device as claimed in claim 2, wherein a front and a rear of the outer side of each supporting panel respectively open a fastening hole, the automatic page-turning device further includes a plurality of supporting pillars and fastening elements, one supporting pillar passes through one of the fastening holes to be fastened to the corresponding loading panel, two fastening elements are respectively fastened above the fastening hole and below the fastening hole for fastening the outer side of the supporting panel between the two fastening elements, the inclination of the supporting panel with respect to the corresponding loading panel can be modulated by means of modulating a vertical position of the fastening hole located in the corresponding supporting pillar.

4. The automatic page-turning device as claimed in claim 2, wherein the pick-up holder mounted on the lower plate of the base includes a fastening board, an assembling holder mounted to the fastening board, the driving mechanism disposed to the assembling holder, a connecting stick mounted to the assembling holder, and a flexible seat movably mounted to the connecting stick of the assembling holder, the fastening board is mounted to the lower plate along an upward and rightward direction, the assembling holder is slantwise mounted to the fastening board, and is gradually inclined forward from a left side thereof to a right side thereof, the connecting stick is slantwise connected between two sides of the assembling holder, and is inclined forward from a left side thereof to a right side thereof, the flexible seat is slidably disposed to the connecting stick, the system controller controls the driving mechanism to drive the flexible seat to slide along the connecting stick, a front of the pick-up arm is pivoted to the connecting stick of the flexible seat so that the system controller is capable of further making the driving mechanism drive the pick-up arm to swing upward and downward by pivoting the connecting stick of the pick-up holder, and the system controller controls the pick-up arm to keep pressing down on the pages of the book during the process of turning the uppermost page.

5. The automatic page-turning device as claimed in claim 4, wherein the assembling holder has a bottom board, two side boards extending upward from two opposite sides of the bottom board, a front board connecting with the two side boards and the bottom board, and a top board connecting with the two side boards and the front board, the connecting stick is connected between the two side boards.

6. The automatic page-turning device as claimed in claim 4, wherein a left side of the fastening board is pivoted to the lower plate and a right side of the fastening board is set freely, the right side of the fastening board defines a fixing hole, one supporting pillar passes through the fixing hole to be fastened to the lower plate, two fastening elements are respectively fastened above the fixing hole and below the fixing hole for fastening the right side of the fastening board between the two fastening elements.

7. The automatic page-turning device as claimed in claim 4, wherein the path guiding mechanism includes a guiding rod located in front of a middle of the book support and parallel to the upper plate, and a lifting rod disposed in front of a left side of the book support, the guiding rod can integrate with the lifting rod to be disposed to the upper plate, the guiding rod and the lifting rod can be respectively disposed to the upper plate.

8. The automatic page-turning device as claimed in claim 7, wherein the right end of the lifting rod further projects under the guiding rod to be located in front of a junction of the two supporting panels so as to make the guiding rod and the lifting rod cross set, the rear end of the pick-up arm is movably disposed above the guiding rod and the lifting rod of the path guiding mechanism, the rear end of the pick-up arm can swing downward to press down on the supporting panel or swing upward away from the supporting panel under the guidance of the connecting stick, the guiding rod and the lifting rod.

9. The automatic page-turning device as claimed in claim 7, wherein two first auxiliary fastening portions are mounted to a left side and a right side of a front of the upper plate of the base to be located in front of the book support, a second auxiliary fastening portion is mounted to the left side of the front of the upper plate of the base, and further located in left of the first auxiliary fastening portion which is mounted to the left side of the front of the upper plate, the second auxiliary fastening portion is higher than the first auxiliary fastening portions, two opposite ends of the guiding rod are mounted to the two first auxiliary fastening portions to make the guiding rod located in front of the middle of the book support and parallel to the upper plate, a left end of the lifting rod is mounted to a top of the second auxiliary fastening portion, and a right end of the lifting rod is connected with a middle of the guiding rod to make the lifting rod slantwise disposed in front of the left side of the book support.

10. The automatic page-turning device as claimed in claim 2, wherein a bottom surface of the upper plate protrudes downward to form a plurality of propping columns for propping up the upper plate.

11. The automatic page-turning device as claimed in claim 1, wherein the driving module further includes a motor, and a gear assembly mounted to an axle of the motor, one end of the pressing plate is mounted to the gear assembly and the other end of the pressing plate is set freely, the system controller controls the motor to rotate to drive the gear assembly to rotate clockwise or anticlockwise so as to raise up the pressing plate away from the uppermost page of the right side of the book or lower the pressing plate to press down on the uppermost page of the right side of the book.

12. The automatic page-turning device as claimed in claim 1, further comprising an auxiliary pressing module mounted to the upper plate, the auxiliary pressing module being capable of being raised up away from the supporting panels or lowered to press down on a front and a rear of a middle of the book, the auxiliary pressing module pressing down on the front and the rear of the middle of the book to flatten the pages of the book before the automatic page-turning device picking up the uppermost page of the right side of the book, and the page-pressing module pressing down on the right permanent position of the uppermost page of the right side of the book for assuring the pick-up and page-turning module to pick up the pages successfully, after the pick-up arm picking up the uppermost page of the right side of the book, the auxiliary pressing module moving upward away from the supporting panels so as to let the pick-up arm turn the uppermost page of the right side of the book successfully, after the automatic page-turning device turning the uppermost page of the right side of the book, the auxiliary pressing module being lowered again to press down on the front and the rear of the middle of the book to flatten the pages of the book, then the auxiliary pressing module being raised up for making the pick-up arm successfully return to the right side of the book, repeating the reciprocating operations like the above-mentioned description.

13. The automatic page-turning device as claimed in claim 1, wherein the system controller is capable of further making the driving mechanism drive the pick-up arm to swing upward and downward by pivoting the pick-up holder for the convenience of putting and taking the book.

14. An automatic page-turning scan device for automatically turning and scanning pages of a book, comprising:

an automatic page-turning device including a base, a book support slidably mounted to the base along a left-to-right direction, and including two supporting panels located above a left side and a right side of the base respectively for supporting the book, a page-pressing module mounted to a right side of the supporting panel which is located above the right side of the base, the page-pressing module including a driving module, and a pressing plate driven by the driving module, a distance between the pressing plate and a front edge of each page of the book being permanent, a pick-up and page-turning module mounted to the base and located in front of the book support, the pick-up and page-turning module including a pick-up holder having a driving mechanism, a pick-up arm and a path guiding mechanism, a front end of the pick-up arm being pivoted to and slidably mounted to the pick-up holder, and a system controller connected with the book support, the page-pressing module and the pick-up and page-turning module, the system controller controlling the driving module to raise up the pressing plate away from an uppermost page of a right side of the book which is supported by the supporting panel located above the right side of the base or lower the pressing plate to press down on the uppermost page of the right side of the book, the system controller controlling the driving mechanism to make the pick-up arm move leftward and rightward along the pick-up holder, in this process, a rear end of the pick-up arm being capable of being raised up away from the pages of the book or lowered to press down on the pages of the book under the cooperation guidance of the path guiding mechanism and the pick-up holder; and a scan module mounted to the automatic page-turning device, and controlled by the system controller to scan the pages of the book, wherein the pressing plate presses down on a right permanent position of the uppermost page of the right side of the book to fasten the uppermost page, the pick-up arm moves leftward and downward to make the rear end thereof rub against and further take along a right corner of a front of the uppermost page of the right side of the book so as to make a front edge of the uppermost page ruckled and spaced from the other pages, the pick-up arm goes on moving and the uppermost page keeps being fastened by the pressing plate so that cause the uppermost page to rebound over the pick-up arm, then the pressing plate is raised up away from the uppermost page of the right side of the book, the pick-up arm further moves leftward under the cooperation guidance of the path guiding mechanism and the pick-up holder to be raised up so as to complete turning the uppermost page leftward.

15. The automatic page-turning scan device as claimed in claim 14, wherein the base includes an upper plate, a lower plate and a connecting plate, the upper plate and the lower plate are disposed horizontally, the connecting plate is connected between a front of the upper plate and a rear of the lower plate, the two loading panels are slidably mounted to a left side and a right side of the upper plate of the base and capable of sliding leftward and rightward along the upper plate, the two loading panels are permanently connected with each other and spaced from each other, two inner sides of the two supporting panels are connected with two inner sides of the two loading panels, and two outer sides of the two supporting panels are propped up by the two loading panels and are inclined upward and oppositely, the system controller controls horizontal positions of the loading panels to drive the supporting panels to move leftward and rightward.

16. The automatic page-turning scan device as claimed in claim 15, wherein a front and a rear of the outer side of each supporting panel respectively open a fastening hole, the automatic page-turning device further includes a plurality of supporting pillars and fastening elements, one supporting pillar passes through one of the fastening holes to be fastened to the corresponding loading panel, two fastening elements are respectively fastened above the fastening hole and below the fastening hole for fastening the outer side of the supporting panel between the two fastening elements, the inclination of the supporting panel with respect to the corresponding loading panel can be modulated by means of modulating a vertical position of the fastening hole located in the corresponding supporting pillar.

17. The automatic page-turning scan device as claimed in claim 15, wherein the pick-up holder mounted on the lower plate of the base includes a fastening board, an assembling holder mounted to the fastening board, the driving mechanism disposed to the assembling holder, a connecting stick mounted to the assembling holder, and a flexible seat movably mounted to the connecting stick of the assembling holder, the fastening board is mounted to the lower plate along an upward and rightward direction, the assembling holder is slantwise mounted to the fastening board, and is gradually inclined forward from a left side thereof to a right side thereof, the connecting stick is slantwise connected between two sides of the assembling holder, and is inclined forward from a left side thereof to a right side thereof, the flexible seat is slidably disposed to the connecting stick, the system controller controls the driving mechanism to drive the flexible seat to slide along the connecting stick under a control of the system controller, a front of the pick-up arm is pivoted to the connecting stick of the flexible seat so that the system controller is capable of further making the driving mechanism drive the pick-up arm to swing upward and downward by pivoting the connecting stick of the pick-up holder, and the system controller controls the pick-up arm to keep pressing down on the pages of the book during the process of turning the uppermost page of the right side of the book.

18. The automatic page-turning scan device as claimed in claim 17, wherein the assembling holder has a bottom board, two side boards extending upward from two opposite sides of the bottom board, a front board connecting with the two side boards and the bottom board, and a top board connecting with the two side boards and the front board, the connecting stick is connected between the two side boards.

19. The automatic page-turning scan device as claimed in claim 17, wherein a left side of the fastening board is pivoted to the lower plate and a right side of the fastening board is set freely, the right side of the fastening board defines a fixing hole, one supporting pillar passes through the fixing hole to be fastened to the lower plate, two fastening elements are respectively fastened above the fixing hole and below the fixing hole for fastening the right side of the fastening board between the two fastening elements.

20. The automatic page-turning scan device as claimed in claim 17, wherein the path guiding mechanism includes a guiding rod located in front of a middle of the book support and parallel to the upper plate, and a lifting rod disposed in front of a left side of the book support, the guiding rod can integrate with the lifting rod to be disposed to the upper plate, the guiding rod and the lifting rod can be respectively disposed to the upper plate.

21. The automatic page-turning scan device as claimed in claim 20, wherein the right end of the lifting rod further projects under the guiding rod to be located in front of a junction of the two supporting panels so as to make the guiding rod and the lifting rod cross set, the rear end of the pick-up arm is movably disposed above the guiding rod and the lifting rod of the path guiding mechanism, the rear end of the pick-up arm can swing downward to press down on the supporting panel or swing upward away from the supporting panel under the guidance of the connecting stick, the guiding rod and the lifting rod.

22. The automatic page-turning scan device as claimed in claim 20, wherein two first auxiliary fastening portions are mounted to a left side and a right side of a front of the upper plate of the base to be located in front of the book support, a second auxiliary fastening portion is mounted to the left side of the front of the upper plate of the base, and further located in left of the first auxiliary fastening portion which is mounted to the left side of the front of the upper plate, the second auxiliary fastening portion is higher than the first auxiliary fastening portions, two opposite ends of the guiding rod are mounted to the two first auxiliary fastening portions to make the guiding rod located in front of the middle of the book support and parallel to the upper plate, a left end of the lifting rod is mounted to a top of the second auxiliary fastening portion, and a right end of the lifting rod is connected with a middle of the guiding rod to make the lifting rod slantwise disposed in front of the left side of the book support.

23. The automatic page-turning scan device as claimed in claim 15, wherein a bottom surface of the upper plate protrudes downward to form a plurality of propping columns for propping up the upper plate.

24. The automatic page-turning scan device as claimed in claim 14, wherein the driving module further includes a motor, and a gear assembly mounted to an axle of the motor, one end of the pressing plate is mounted to the gear assembly and the other end of the pressing plate is set freely, the system controller controls the motor to rotate to drive the gear assembly to rotate clockwise or anticlockwise so as to raise up the pressing plate away from the uppermost page of the right side of the book or lower the pressing plate to press down on the uppermost page of the right side of the book.

25. The automatic page-turning scan device as claimed in claim 14, wherein the automatic page-turning device of the automatic page-turning scan device further includes an auxiliary pressing module mounted to the upper plate, the auxiliary pressing module is capable of being raised up away from the supporting panels or lowered to press down on a front and a rear of a middle of the book, the auxiliary pressing module presses down on the front and the rear of the middle of the book before the automatic page-turning device picking up the pages of the book before the automatic page-turning device picking up the uppermost page of the right side of the book to flatten the pages of the book, and the page-pressing module presses down on the right permanent position of the uppermost page of the right side of the book for assuring the pick-up and page-turning module to pick up the pages successfully, after the pick-up arm picking up the uppermost page of the right side of the book, the auxiliary pressing module moves upward away from the supporting panels so as to let the pick-up arm turn the uppermost page of the right side of the book successfully, after the automatic page-turning device turning the uppermost page of the right side of the book, the auxiliary pressing module is lowered again to press down on the front and the rear of the middle of the book to flatten the pages of the book, then the auxiliary pressing module is raised up for making the pick-up arm successfully return to the right side of the book, repeat the reciprocating operations like the above-mentioned description.

26. The automatic page-turning scan device as claimed in claim 14, wherein the scan module is disposed above the book support.

27. The automatic page-turning device as claimed in claim 14, wherein the system controller is capable of further making the driving mechanism drive the pick-up arm to swing upward and downward by pivoting the pick-up holder for the convenience of putting and taking the book.

* * * * *